US010237930B2

(12) United States Patent
Jongerius

(10) Patent No.: US 10,237,930 B2
(45) Date of Patent: Mar. 19, 2019

(54) POWER SUPPLY FOR DEEP DIMMING LIGHT

(71) Applicant: PHILIPS LIGHTING HOLDING B.V., Eindhoven (NL)

(72) Inventor: Bernardus Arnoldus Gerardus Jongerius, Breda (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/540,196

(22) PCT Filed: Dec. 18, 2015

(86) PCT No.: PCT/EP2015/080528
§ 371 (c)(1),
(2) Date: Jun. 27, 2017

(87) PCT Pub. No.: WO2016/110396
PCT Pub. Date: Jul. 14, 2016

(65) Prior Publication Data

US 2017/0359870 A1 Dec. 14, 2017

(30) Foreign Application Priority Data

Jan. 5, 2015 (EP) ..... 15150093

(51) Int. Cl.
*H05B 33/08* (2006.01)

(52) U.S. Cl.
CPC ..... *H05B 33/0815* (2013.01); *H05B 33/0845* (2013.01)

(58) Field of Classification Search
None
See application file for complete search history.

(56) References Cited

U.S. PATENT DOCUMENTS 4,051,411 A * 9/1977 Knoble ..... H05B 41/34 315/205
4,217,874 A * 8/1980 Sohner ..... F02P 7/067 123/617

(Continued)

FOREIGN PATENT DOCUMENTS

CN 102577606 A 7/2012
CN 102843821 A 12/2012
EP 2538753 A1 12/2012

OTHER PUBLICATIONS

Michael T. Zhang et al, "Design Considerations and Performance Evaluations of Synchronous Rectification in Flyback Converters", IEEE Trans. on Power Electronics, Inst. of Electrical and Electronics Engineers, USA. vol. 13, No. 3, May 1, 1998, ISSN: 0885-8993, XP011043184.

*Primary Examiner* — Crystal L Hammond

(57) ABSTRACT

Power supplies (1) comprise first induction circuits (11) for receiving first amounts of power from source circuits, second induction circuits (12) for providing second amounts of power to combinations (2) of light circuits (21) and capacitor circuits (22), control circuits (13) for controlling the second amounts, and trigger circuits (14) for bringing the control circuits (13) into first modes having first durations equal to time-intervals. The control circuits (13) in the first modes guide supplying current signals for supplying the combinations (2) and subsequently discharging current signals for reducing charges of the capacitor circuits (22) and in second modes prevent the flowing of the discharging current signals. The light circuits (21) experience low output levels without experiencing low frequency ripples. The control circuits (3) may comprise parallel combinations of transistors (15) such as field effect transistors and diodes (16) such as parasitic-reverse-diodes of the field effect (Continued)

transistors. The first/second modes may be conducting/non-conducting modes of the transistors (15).

15 Claims, 3 Drawing Sheets

(56) References Cited

U.S. PATENT DOCUMENTS

| | | | | |
|---|---|---|---|---|
| 5,164,892 | A * | 11/1992 | Kimbara | H01S 3/092 323/224 |
| 5,384,518 | A * | 1/1995 | Kido | H02M 1/36 315/106 |
| 6,175,195 | B1 * | 1/2001 | Janczak | H05B 41/295 315/194 |
| 7,239,090 | B2 * | 7/2007 | Okamoto | H05B 41/2881 315/219 |
| 2006/0061299 | A1 | 3/2006 | Urakabe et al. | |
| 2006/0171180 | A1 * | 8/2006 | Kyono | H02M 3/33592 363/95 |
| 2007/0103946 | A1 * | 5/2007 | Kyono | H02M 3/33592 363/21.14 |
| 2012/0081928 | A1 | 4/2012 | Roessler et al. | |
| 2012/0181944 | A1 * | 7/2012 | Jacobs | H05B 33/0815 315/224 |
| 2013/0194836 | A1 | 8/2013 | Morris et al. | |
| 2013/0235620 | A1 | 9/2013 | Morris et al. | |
| 2014/0092646 | A1 * | 4/2014 | Cleveland | H02M 3/3353 363/21.14 |
| 2016/0338158 | A1 * | 11/2016 | Zhou | H05B 33/0818 |
| 2017/0290119 | A1 * | 10/2017 | Xiong | F21V 3/061 |

* cited by examiner

POWER SUPPLY FOR DEEP DIMMING LIGHT

CROSS-REFERENCE TO PRIOR APPLICATIONS

This application is the U.S. National Phase application under 35 U.S.C. § 371 of International Application No. PCT/EP2015/080528, filed on DEC. 18, 2015 which claims the benefit of European Patent Application No. 15150093.1, filed on JAN. 5, 2015. These applications are hereby incorporated by reference herein.

FIELD OF THE INVENTION

The invention relates to a power supply for supplying a combination of a light circuit and a capacitor circuit. The invention further relates to a device, and to a method. Examples of such a power supply are switched mode power supplies.

BACKGROUND OF THE INVENTION

Switched mode power supplies are of common general knowledge. Most of these need a certain minimum output level to operate properly. Below the minimum output level, the switched mode power supply may enter a burst mode or a skipping mode. In this mode there can be a low frequency ripple on the output. When using the output for feeding a light circuit, this low frequency ripple can be disturbing to a user.

SUMMARY OF THE INVENTION

It is an object of the invention to provide an improved power supply. Further objects of the invention are to provide a device and an improved method.

According to a first aspect, a power supply is provided for supplying a combination of a light circuit and a capacitor circuit, the power supply comprising

- a first induction circuit for receiving a first amount of power from a source circuit,
- a second induction circuit coupled to the first induction circuit for providing a second amount of power to the combination,
- a control circuit for controlling the second amount of power, and
- a trigger circuit for bringing the control circuit into a first mode having a first duration equal to a time-interval, the control circuit being configured to, in the first mode, guide a supplying current signal for supplying the combination and subsequently a discharging current signal for reducing a charge of the capacitor circuit, and to, in a second mode of the control circuit, prevent the flowing of the discharging current signal.

A first induction circuit receives a first amount of power from a source circuit, possibly via a dimmer circuit. A second induction circuit provides a second amount of power to a combination of a light circuit and a capacitor circuit. Thereto, the first and second induction circuits are coupled. A control circuit controls the second amount of power. A trigger circuit brings the control circuit into a first mode having a first duration equal to a time-interval. The control circuit is configured to, in the first mode, guide a supplying current signal for supplying the combination and subsequently a discharging current signal for reducing a charge of the capacitor circuit. The control circuit is configured to, in a second mode of the control circuit, prevent the flowing of the discharging current signal through the control circuit.

So, a control circuit has been introduced that, during a time-interval, guides (conducts) a supplying current signal for supplying the combination of the light circuit and the capacitor circuit and subsequently guides (conducts) a discharging current signal for reducing a charge of the capacitor circuit. After this time-interval has elapsed, the capacitor circuit is not further discharged via the control circuit. In other words, during the time interval, firstly, power is supplied to the combination of the light circuit and the capacitor circuit, and, secondly, some of the power supplied is withdrawn from the capacitor circuit and used for charging the second induction circuit. After the time-interval has elapsed, further power is not withdrawn from the capacitor circuit. This way, the light circuit is fed by an amount of power that is a difference between the amount of power supplied to the combination via the supplying current signal and the amount of power withdrawn from the capacitor circuit via the discharging current signal. As a result, the light circuit experiences a low output level without experiencing a low frequency ripple. This is a great technical advantage.

The source circuit may comprise a rectifier for rectifying a mains signal or may comprise a battery or may comprise any other kind of source circuit. The capacitor circuit may comprise one or more capacitors of whatever kind and combined in whatever way. The first induction circuit may comprise one or more first inductors of whatever kind and combined in whatever way. The second induction circuit may comprise one or more second inductors of whatever kind and combined in whatever way. The supplying current signal supplies power to the combination of the light circuit and the capacitor circuit. The discharging current signal discharges the capacitor circuit via the control circuit entirely or only to some extent. The combination of the light circuit and the capacitor circuit usually comprises a parallel combination of the light circuit and the capacitor circuit, without having excluded other kinds of combinations. The capacitor circuit may be a part of the light circuit or not. When being a part of the light circuit, the capacitor circuit may be a parasitic capacitance of the light circuit or may be a separate capacitance added to the light circuit.

An embodiment of the power supply is defined by the control circuit comprising a parallel combination of a transistor and a diode. This is a low cost, simple and robust embodiment.

An embodiment of the power supply is defined by the transistor comprising a field effect transistor, and the diode comprising a parasitic-reverse-diode of the field effect transistor, or the transistor comprising a bipolar transistor, and the diode comprising a reverse-diode. This is an efficient embodiment owing to the fact that a field effect transistor comprises a parasitic-reverse-diode per se and owing to the fact that a bipolar transistor can be easily combined with a reverse-diode. A reverse-diode of the bipolar transistor may be a parasitic-reverse-diode of the bipolar transistor or may be a reverse-diode added to the bipolar transistor.

An embodiment of the power supply is defined by the first mode comprising a conducting mode of the transistor and the second mode comprising a non-conducting mode of the transistor. The diode can guide the supplying current signal when the transistor is non-conducting. The transistor can guide the supplying current signal and the discharging current signal when the transistor is conducting. The diode cannot guide the discharging current signal owing to the fact that the supplying current signal and the discharging current signal flow in opposite directions.

An embodiment of the power supply is defined by a length of the time-interval having a substantially fixed value. Preferably, the lengths of the time-intervals will each have one and the same fixed value, to allow the trigger circuit to be realized through a most simple embodiment. However, the lengths of the time-intervals may alternatively each have a substantially fixed value, for example in case the values of the lengths of the time-intervals each do not deviate too much (for example <10%) from an average value of the lengths of a group of time-intervals etc.

An embodiment of the power supply is defined by the first amount of power comprising power pulses having a period larger than the time-interval. In a switched mode power supply, the first amount of power supplied from the source circuit to the first induction circuit usually comprises power pulses. Preferably, a length of a period of these power pulses may be larger than a length of the time-interval.

An embodiment of the power supply is defined by the trigger circuit being configured to bring the control circuit into the first mode in response to a detection of an end of a power pulse. Preferably, during a power pulse, a primary part of the power supply comprising the first induction circuit is active and a secondary part of the power supply comprising the second induction circuit and the control circuit is inactive, and between two subsequent power pulses, the primary part of the power supply is inactive and the secondary part of the power supply is active.

An embodiment of the power supply is defined by the power supply having a normal dimming mode and a deep dimming mode. In a normal dimming mode, a power supply for example supplies 10% to 100% of a maximum output power to a load. In a deep dimming mode, the power supply for example supplies 1% to 10% of the maximum output power to the load. Dimming may for example be realized via a dimmer circuit located between the source circuit and the power supply and/or may for example be realized by controlling a width of the power pulses.

An embodiment of the power supply is defined by the control circuit being configured in the deep dimming mode to, in the first mode, guide the supplying current signal and subsequently the discharging current signal, and to, in the second mode, prevent the flowing of the discharging current signal, and the control circuit being configured in the normal dimming mode to, in the first mode, only guide the supplying current signal, and to, in the second mode, only guide the supplying current signal during at most a part of a second duration of the second mode. In the deep dimming mode, the capacitor circuit is at least partly discharged via the control circuit, in the normal dimming mode it is not discharged via the control circuit.

An embodiment of the power supply is defined by the first amount of power comprising power pulses, the power supply being configured to go into the deep dimming mode in response to a width of a power pulse being smaller than a threshold value, and the power supply being configured to go into the normal dimming mode in response to the width of the power pulse being larger than the threshold value. A width of a power pulse may determine an amount of light produced by the light circuit. A smaller/larger width may result in less/more light being produced.

An embodiment of the power supply is defined by the first induction circuit comprising a first winding and the second induction circuit comprising a second winding, wherein both windings are inductively coupled, or the respective first and second induction circuits comprising respective first and second parts of one and the same winding. In case the respective first and second induction circuits comprise respective first and second windings, both windings need to be inductively coupled. In case the respective first and second induction circuits comprise respective first and second parts of one and the same winding, both parts will be inductively coupled. Both parts may be the same part or different overlapping parts or different non-overlapping parts of the winding.

An embodiment of the power supply is defined by the trigger circuit comprising an integrated circuit for detecting a voltage signal present at the second induction circuit and for in response to a detection result generating a control signal for bringing the control circuit into one of the modes, or the trigger circuit comprising a detector circuit for detecting a voltage signal present at the second induction circuit and a generator circuit for in response to a detection result from the detector circuit generating a control signal for bringing the control circuit into one of the modes. An integrated circuit may cost more but require less space, and a detector circuit and a generator circuit may cost less but require more space.

According to a second aspect, a device is provided comprising the power supply as defined above and further comprising the combination of the light circuit and the capacitor circuit.

An embodiment of the device is defined by the light circuit comprising a light emitting diode circuit. A light emitting diode circuit comprises one or more light emitting diodes of whatever kind and combined in whatever way.

According to a third aspect, a method is provided for operating a power supply for supplying a combination of a light circuit and a capacitor circuit, the power supply comprising

- a first induction circuit for receiving a first amount of power from a source circuit,
- a second induction circuit coupled to the first induction circuit for providing a second amount of power to the combination, and
- a control circuit for controlling the second amount of power, the method comprising a step of bringing the control circuit into a first mode having a first duration equal to a time-interval, the control circuit being configured to, in the first mode, guide a supplying current signal for supplying the combination and subsequently a discharging current signal for reducing a charge of the capacitor circuit, and to, in a second mode of the control circuit, prevent the flowing of the discharging current signal.

An insight is that power can be supplied to a combination of a light circuit and a capacitor circuit and that power can be withdrawn from the capacitor circuit. A basic idea is that, in a first mode of a control circuit, a supplying current signal is to be guided for supplying the combination and subsequently a discharging current signal is to be guided for partly or entirely discharging the capacitor circuit, and that, in a second mode of the control circuit, the flowing of this discharging current signal is to be prevented.

A problem to provide an improved power supply has been solved. Further advantages are that the control circuit and the trigger circuit and a triggering driving algorithm are easy to realize, and that the power supply is low cost, simple and robust.

These and other aspects of the invention will be apparent from and elucidated with reference to the embodiments described hereinafter.

DETAILED DESCRIPTION OF EMBODIMENTS

Figure 1:
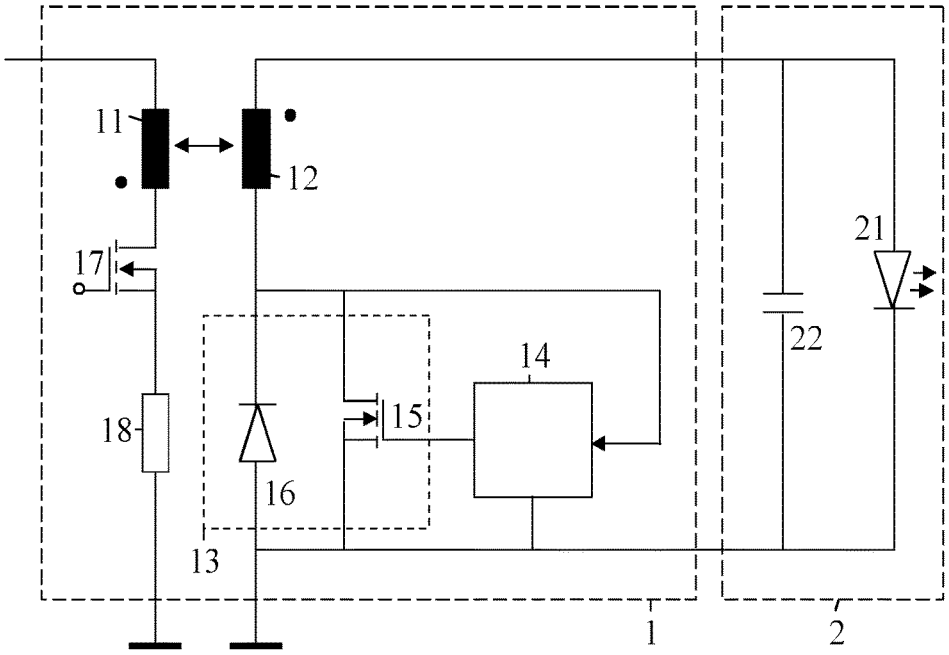
FIG. 1 shows an embodiment of a power supply.

In the FIG. 1, an embodiment of a power supply 1 is shown. The power supply 1 comprises a first induction circuit 11 for receiving a first amount of power from a source circuit not shown. Thereto, one end of the first induction circuit 11 is to be coupled to the source circuit, possibly via further circuitry and/or possibly via a dimmer. The other end of the first induction circuit 11 is coupled to a first main electrode (drain) of a switch circuit 17 such as a field effect transistor. A second main electrode (source) of the switch circuit 17 is coupled to ground via a resistor 18. In this exemplary case, the first amount of power comprises power pulses. Via a control signal provided to a control electrode (gate) of the switch circuit 17, a period and a width of the power pulses can be controlled.

The power supply 1 further comprises a second induction circuit 12 that in this exemplary case is inductively coupled to the first induction circuit 11. Thereto, the first induction circuit 11 comprises a first winding and the second induction circuit 12 comprises a second winding, wherein both windings are inductively coupled. Alternatively, the respective first and second induction circuits 11, 12 may comprise respective first and second parts of one and the same winding, which first and second parts are then inductively coupled per se.

The second induction circuit 12 provides a second amount of power to a parallel combination 2 of a light circuit 21 and a capacitor circuit 22. The power supply 1 further comprises a control circuit 13 for controlling the second amount of power, and a trigger circuit 14 for bringing the control circuit 13 into a first mode having a first duration equal to a time-interval. Thereto, one end of the second induction circuit 12 is coupled to one end of the combination 2. The other end of the second induction circuit 12 is coupled to a first main electrode of the control circuit 13 and to an input of the trigger circuit 14. A second main electrode of the control circuit 13 is coupled to ground. An output of the trigger circuit 14 is coupled to a control electrode of the control circuit 13. The other end of the parallel combination 2 is coupled to ground too.

The control circuit 13 is configured to, in the first mode, guide a supplying current signal for supplying the combination 2 and subsequently guide a discharging current signal for reducing a charge of the capacitor circuit 22, and to, in a second mode of the control circuit 13, prevent the flowing of the discharging current signal.

Preferably, the control circuit 13 comprises a parallel combination of a transistor 15 and a diode 16. The transistor 15 may comprise a field effect transistor, and the diode 16 may comprise a parasitic-reverse-diode of the field effect transistor. The first mode may comprise a conducting mode of the transistor 15 and the second mode may comprise a non-conducting mode of the transistor 15. The first and second main electrodes of the control circuit 13 may be the first and second main electrodes of the transistor 15 (drain and source), and the control electrode of the control circuit 13 may be the control electrode (gate) of the transistor 15. In a conducting mode, the transistor 15 may conduct the supplying current signal and the discharging current signal. When the transistor 15 is not conducting, the diode 16 may conduct the supplying current signal. The diode 16 cannot conduct the discharging current signal owing to the fact that the supplying current signal and the discharging current signal flow in opposite directions: The supplying current signal flows from the second induction circuit 12 through the combination 2 and through the control circuit 13 (through the transistor 15 when conducting or through the diode 16) back to the second induction circuit 12. The discharging current signal flows from the capacitor circuit 22 through the second induction circuit 12 (while charging this second induction circuit 12) and through the control circuit 13 (only in case the transistor 15 is conducting) back to the capacitor circuit 22.

Preferably, a length of the time-interval may have a substantially fixed value, such as for example a fixed value. The power pulses may have a period larger than the time-interval. The trigger circuit 14 may be configured to bring the control circuit 13 into the first mode in response to a detection of an end of a power pulse, as will be further discussed at the hand of the FIGS. 3 and 4.

Preferably, the power supply 1 may have a normal dimming mode and a deep dimming mode. The control circuit 13 may be configured in the deep dimming mode to, in the first mode, guide the supplying current signal and subsequently guide the discharging current signal, and to, in the second mode, prevent the flowing of the discharging current signal, and the control circuit 13 may be configured in the normal dimming mode to, in the first mode, only guide the supplying current signal, and to, in the second mode, only guide the supplying current signal during at most a part of a second duration of the second mode. The power supply 1 is configured to go into the deep dimming mode in response to a width of a power pulse being smaller than a threshold value, and the power supply 1 is configured to go into the normal dimming mode in response to the width of the power pulse being larger than the threshold value, as will be further discussed at the hand of the FIGS. 3 and 4. A sum of the first duration of the first mode (the time-interval) and the second duration of the second mode will usually be equal to the period of the power pulses.

In the FIG. 1, the trigger circuit 14 comprises for example an integrated circuit for detecting a voltage signal present at the second induction circuit 12 and for in response to a detection result generating a control signal for bringing the control circuit 13 into one of the modes.

Figure 2:
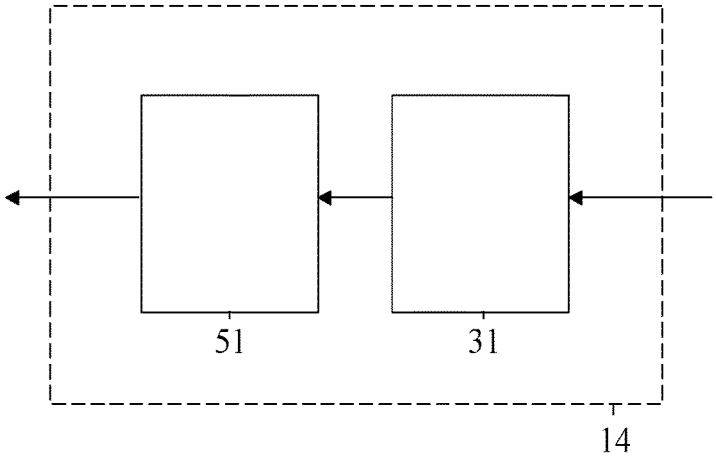
FIG. 2 shows an embodiment of a trigger circuit.

In the FIG. 2, an embodiment of a trigger circuit 14 is shown. This trigger circuit 14 differs from the previously discussed integrated circuit in that this trigger circuit 14 comprises a detector circuit 31 for detecting a voltage signal present at the second induction circuit 12 and a generator circuit 51 for in response to a detection result from the detector circuit 31 generating a control signal for bringing the control circuit 13 into one of the modes. The detector circuit 31 is shown in and discussed at the hand of the FIG. 5, and the generator circuit 51 is shown in and discussed at the hand of the FIG. 6.

Figure 3:
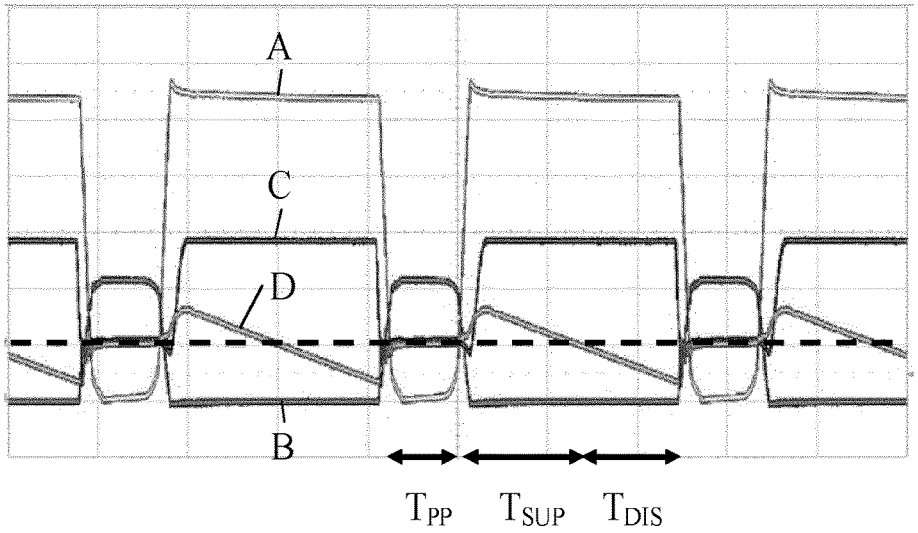
FIG. 3 shows waveforms in a deep dimming mode.

In the FIG. 3, waveforms are shown in a deep dimming mode. A waveform A corresponds with a voltage signal present between the first induction circuit 11 and the switch circuit 17 on the one hand and ground on the other hand. During a time length $T_{PP}$, the waveform A has a minimum value owing to the fact that the switch circuit 17 is in a conducting mode, and a power pulse is present. A waveform B corresponds with a voltage signal present between the second induction circuit 12 and the control circuit 13 on the one hand and ground on the other hand. This voltage signal is an input signal for the trigger circuit 14. Clearly, when the waveform A is maximal, the waveform B is minimal, and vice versa, which results in the trigger circuit 14 bringing the control circuit 13 into the first mode in response to a detection of an end of a power pulse.

A waveform C corresponds with a control signal generated by the trigger circuit 14 for bringing the control circuit 13 in one of the modes. Here, the waveform C has, when ignoring delays and transitions, a zero value during a power pulse. The waveform C has a maximum value between two subsequent power pulses. A duration of this maximum value is equal to the time-interval having the length with the substantially fixed value (the first duration of the first mode). The waveform D corresponds with a current signal flowing between the second induction circuit 12 and the combination 2. Clearly, during a time length $T_{SUP}$, the waveform D has a positive value (situated above the dashed line), which means that a supplying current signal is flowing from the second induction circuit 12 to the combination 2. During a time length $T_{DIS}$, the waveform D has a negative value (situated below the dashed line), which means that a discharging current signal is flowing from the capacitor circuit 22 to the second induction circuit 12.

Figure 4:
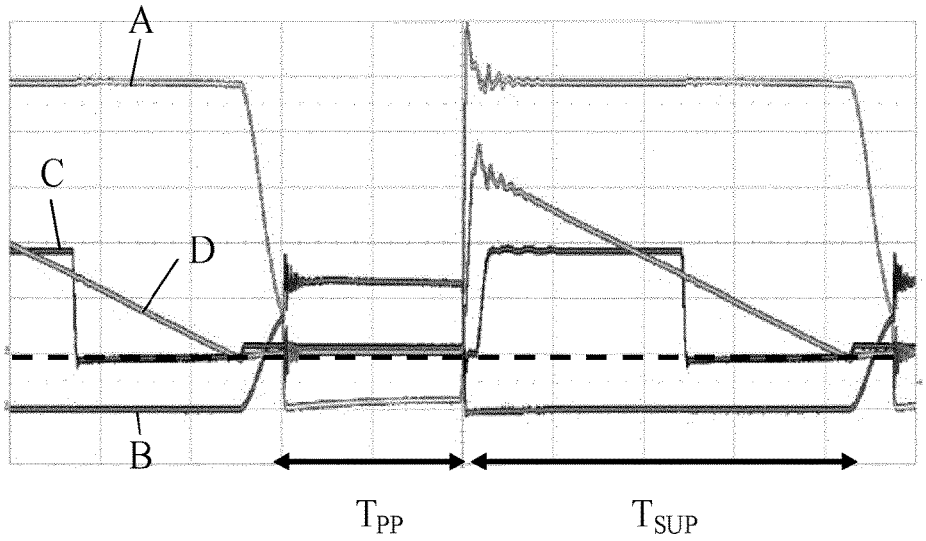
FIG. 4 shows waveforms in a normal dimming mode.

In the FIG. 4, waveforms are shown in a normal dimming mode. Again, the waveform A corresponds with the voltage signal present between the first induction circuit 11 and the switch circuit 17 on the one hand and ground on the other hand. During a time length $T_{PP}$, the waveform A has a minimum value owing to the fact that the switch circuit 17 is in a conducting mode, and a power pulse is present. The waveform B corresponds with the voltage signal present between the second induction circuit 12 and the control circuit 13 on the one hand and ground on the other hand. This voltage signal is the input signal for the trigger circuit 14. Clearly, when the waveform A is maximal, the waveform B is minimal, and vice versa, which results in the trigger circuit 14 bringing the control circuit 13 into the first mode in response to the detection of the end of the power pulse.

Again, the waveform C corresponds with the control signal generated by the trigger circuit 14 for bringing the control circuit 13 in one of the modes. Here, the waveform C has, when ignoring delays and transitions, a zero value during a power pulse and during a part of the time between two subsequent power pulses. The waveform C has a maximum value during the rest of the time between the two subsequent power pulses. A duration of this maximum value is equal to the time-interval having the length with the substantially fixed value (the first duration of the first mode). Clearly, in the FIGS. 3 and 4, this duration of this maximum value is the same. The waveform D corresponds with the current signal flowing through the second induction circuit 12 and the combination 2. Clearly, during a time length $T_{SUP}$, the waveform D has a positive value (situated above the dashed line), which means that a supplying current signal is flowing from the second induction circuit 12 to the combination 2. Here, the waveform D does not have a negative value (situated below the dashed line), which means that a discharging current signal does not flow here.

So, compared to the FIG. 3 (deep dimming), in the FIG. 4 (normal dimming) $T_{PP}$ has been increased, and a larger first amount of power is provided to the first induction circuit 11 and a larger second amount of power is provided to the combination 2, and as a result, the supplying current signal has got a larger maximum amplitude and a longer duration and the discharging current signal no longer occurs. Owing to the fact that, in the FIG. 3 (deep dimming), the second amount of power as provided to the combination 2 is equal to a difference between an amount of power provided to the combination 2 via the supplying current signal and an amount of power withdrawn from the capacitor circuit 22 via the discharging current signal, the light circuit 21 experiences a low output level without experiencing a low frequency ripple. This is a great technical advantage.

Figure 5:
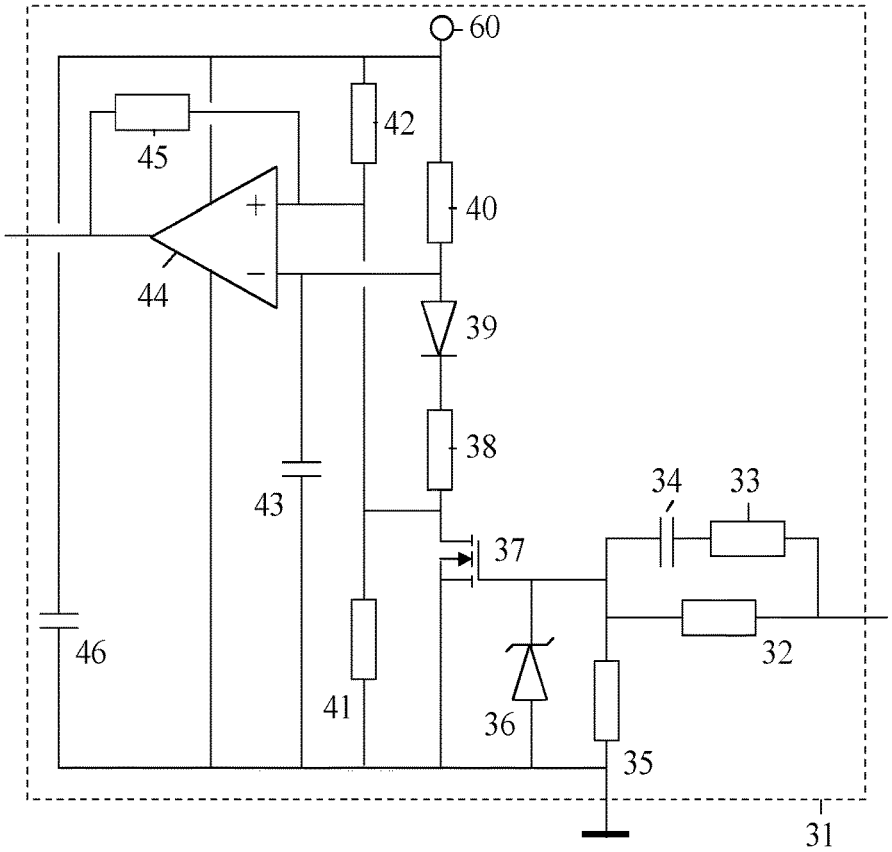
FIG. 5 shows an embodiment of a detector circuit.

In the FIG. 5, an embodiment of a detector circuit 31 is shown. A parallel combination of a resistor 32 and a serial combination of a resistor 33 and a capacitor 34 receives at one end the input signal. Its other end is coupled via a parallel combination of a resistor 35 and a zener diode 36 to ground, and to a control electrode (gate) of a (field effect) transistor 37. A first main electrode (drain) of the transistor 37 is coupled to one end of resistors 38, 41 and 42 and to a non-inverting input of a comparator 44. Another end of the resistor 41 and a second main electrode (source) of the transistor 37 are coupled to ground. Another end of the resistor 38 is coupled via a diode 39 to one end of a resistor 40 and to an inverting input of the comparator 44. Other ends of the resistors 40 and 42 are coupled to a terminal 60 for receiving an auxiliary feeding signal. The inverting input of the comparator 44 is further coupled via a capacitor 43 to ground. The non-inverting input of the comparator 44 is further coupled via a resistor 45 to an output of the comparator 44 that provides a signal with a detection result. The terminal 60 is further coupled to ground via a capacitor 46.

Figure 6:
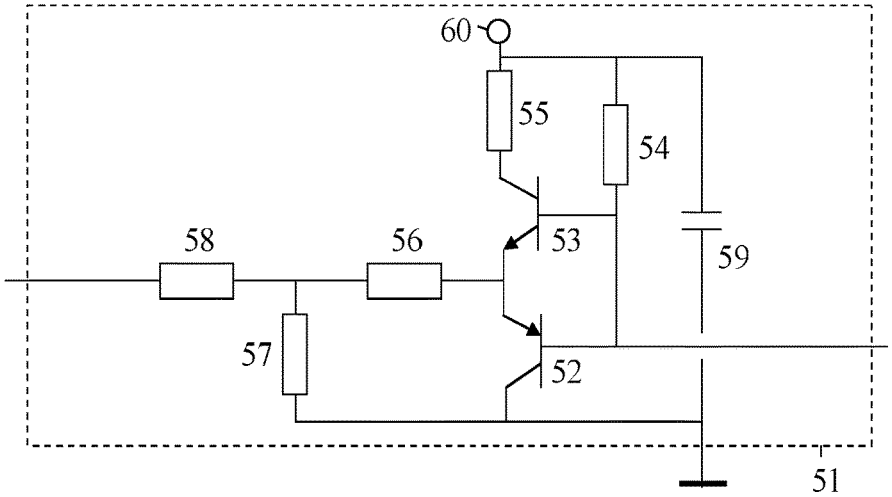
FIG. 6 shows an embodiment of a generator circuit.

In the FIG. 6, an embodiment of a generator circuit 51 is shown. Control electrodes (bases) of (bipolar) transistors 52 and 53 receive the signal with the detection result and are coupled to one end of a resistor 54. First main electrodes (emitters) of the transistors 52 and 53 are coupled to each other and to one end of a resistor 56. A second main electrode (collector) of the transistor 52 is coupled to ground. A second main electrode (collector) of the transistor 53 is coupled via a resistor 55 to the terminal 60 for receiving the auxiliary feeding signal. The terminal 60 is further coupled to another end of the resistor 54 and to ground via a capacitor 59. Another end of the resistor 56 is coupled via a resistor 57 to ground and to one end of a resistor 58. Another end of the resistor 58 provides the control signal for bringing the control circuit 13 into one of the modes.

Alternatively, the capacitor circuit 22 may form part of the power supply 1. First and second elements can be coupled indirectly via a third element and can be coupled directly without the third element being in between. The embodiments shown and discussed are exemplary embodiments only. For example, of the capacitors 46 and 59, one can be left out easily. Instead of a separate detector circuit 31 and a separate generator circuit 51, one integrated circuit or more than two separate circuits may be introduced.

Summarizing, power supplies 1 comprise first induction circuits 11 for receiving first amounts of power from source circuits, second induction circuits 12 for providing second amounts of power to combinations 2 of light circuits 21 and capacitor circuits 22, control circuits 13 for controlling the second amounts, and trigger circuits 14 for bringing the control circuits 13 into first modes having first durations equal to time-intervals. The control circuits 13 in the first modes guide supplying current signals for supplying the combinations 2 and subsequently discharging current signals for reducing charges of the capacitor circuits 22 and in second modes prevent the flowing of the discharging current signals. The light circuits 21 experience low output levels without experiencing low frequency ripples. The control circuits 3 may comprise parallel combinations of transistors 15 such as field effect transistors and diodes 16 such as parasitic-reverse-diodes of the field effect transistors. The first/second modes may be conducting/non-conducting modes of the transistors 15.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A power supply for supplying a combination of a light circuit and a capacitor circuit, the power supply comprising a first induction circuit for receiving a first amount of power from a source circuit, a second induction circuit inductively coupled to the first induction circuit and connected to the combination for providing a second amount of power to the combination, a control circuit serially connected between the second induction circuit and the combination for controlling the second amount of power, and a trigger circuit having an input connected to the second induction circuit for detecting a voltage signal present at the second induction circuit for bringing the control circuit into a first mode having a first duration equal to a time-interval, the control circuit being configured to, in the first mode, guide a supplying current signal for supplying the combination and subsequently a discharging current signal for reducing a charge of the capacitor circuit, and to, in a second mode of the control circuit, prevent the flowing of the discharging current signal.

2. The power supply as defined in claim 1, the control circuit comprising a parallel combination of a transistor and a diode.

3. The power supply as defined in claim 2, the transistor comprising a field effect transistor, and the diode comprising a parasitic-reverse-diode of the field effect transistor, or the transistor comprising a bipolar transistor, and the diode comprising a reverse-diode.

4. The power supply as defined in claim 2, the first mode comprising a conducting mode of the transistor and the second mode comprising a non-conducting mode of the transistor.

5. The power supply as defined in claim 1, a length of the time-interval having a substantially fixed value.

6. The power supply as defined in claim 1, the first amount of power comprising power pulses having a period larger than the time-interval.

7. The power supply as defined in claim 6, the trigger circuit being configured to bring the control circuit into the first mode in response to a detection of an end of a power pulse.

8. The power supply as defined in claim 1, the power supply having a normal dimming mode and a deep dimming mode each supporting the first mode and the second mode.

9. The power supply as defined in claim 8, the control circuit being adapted to, in the deep dimming mode and in the first mode, guide the supplying current signal and subsequently the discharging current signal, and to, in the deep dimming mode and in the second mode, prevent the flowing of the discharging current signal, and the control circuit being adapted to, in the normal dimming mode and in the first mode, only guide the supplying current signal, and to, in the normal mode and in the second mode, only guide the supplying current signal during at most a part of a second duration of the second mode.

10. The power supply as defined in claim 8, the first amount of power comprising power pulses, the power supply being configured to go into the deep dimming mode in response to a width of a power pulse being smaller than a threshold value, and the power supply being configured to go into the normal dimming mode in response to the width of the power pulse being larger than the threshold value.

11. The power supply as defined in claim 1, the first induction circuit comprising a first winding and the second induction circuit comprising a second winding, wherein both windings are inductively coupled, or the respective first and second induction circuits comprising respective first and second parts of one and the same winding.

12. The power supply as defined in claim 1, the trigger circuit comprising an integrated circuit for detecting a voltage signal present at the second induction circuit and for in response to a detection result generating a control signal for bringing the control circuit into one of the modes, or the trigger circuit comprising a detector circuit for detecting a voltage signal present at the second induction circuit and a generator circuit for in response to a detection result from the detector circuit generating a control signal for bringing the control circuit into one of the modes.

13. A device comprising the power supply as defined in claim 1 and further comprising the combination of the light circuit and the capacitor circuit.

14. The device as defined in claim 13, the light circuit comprising a light emitting diode circuit.

15. A method for operating a power supply for supplying a combination of a light circuit and a capacitor circuit, the power supply comprising a first induction circuit for receiving a first amount of power from a source circuit, a second induction circuit coupled to the first induction circuit for providing a second amount of power to the combination, and a control circuit connected to the second induction circuit for controlling the second amount of power, the method comprising, in response to a detected voltage present at the second induction circuit, a step of bringing the control circuit into a first mode having a first duration equal to a time-interval, the control circuit being configured to, in the first mode, guide a supplying current signal for supplying the combination and subsequently a discharging current signal for reducing a charge of the capacitor circuit, and to, in a second mode of the control circuit, prevent the flowing of the discharging current signal.

* * * * *